US005173920A

United States Patent [19]

Bochsler et al.

[11] Patent Number: 5,173,920

[45] Date of Patent: Dec. 22, 1992

[54] DIRECT-CURRENT ELECTRIC-ARC FURNACE

[75] Inventors: Walter Bochsler, Thalwil; Ante Eterovic, Wettingen; Sven-Einar Stenkvist, Brugg, all of Switzerland

[73] Assignee: Asea Brown Boveri Ltd., Baden, Switzerland

[21] Appl. No.: 774,381

[22] Filed: Oct. 10, 1991

Related U.S. Application Data

[63] Continuation of Ser. No. 566,763, Aug. 14, 1990, abandoned.

[30] Foreign Application Priority Data

Aug. 21, 1989 [CH] Switzerland ..... 3027/89

[51] Int. Cl.[5] ..... F27D 1/00

[52] U.S. Cl. ..... 373/72; 373/65; 373/71; 373/108

[58] Field of Search ..... 373/71, 72, 73, 74, 373/79, 60, 81, 82, 84, 108, 60, 65

[56] References Cited

U.S. PATENT DOCUMENTS 1,369,578 2/1921 Trembour .
4,228,314 10/1980 Stenkvist ..... 373/72
4,277,638 7/1981 Stenkvist ..... 373/72

FOREIGN PATENT DOCUMENTS 219649 4/1987 European Pat. Off. .
3022566 . 1/1981 Fed. Rep. of Germany .
670019 8/1929 France .
2188812 1/1974 France .
2577311 8/1986 France .
2143110 1/1985 United Kingdom .

*Primary Examiner*—Bruce A. Reynolds
*Assistant Examiner*—Tu Hoang
*Attorney, Agent, or Firm*—Oblon, Spivak, McClelland, Maier & Neustadt

[57] ABSTRACT

In a direct-current electric-arc furnace, the bottom contact, that is the hearth electrode, must be insulated from the metallic shell of the furnace vessel by insulating material. For this purpose, the bottom plate carrying the bottom contact essentially forms the bottom of the furnace vessel. This bottom contact, with an insulating material, or a material which is at least a poor electrical conductor, inbetween, rests on a part, projecting radially inward, of the metallic vessel shell.

8 Claims, 1 Drawing Sheet

DIRECT-CURRENT ELECTRIC-ARC FURNACE

This application is a continuation of application Ser. No. 07/566,763, filed on Aug. 14, 1990, now abandoned.

BACKGROUND OF THE INVENTION

1. Field of the Invention

The invention relates to a direct-current electric-arc furnace comprising a furnace vessel, which is provided with a metallic shell, at least one electrode connected as cathode, and at least one bottom contact, the bottom of the furnace consisting of a lining layer which has electrically conductive bricks or other identically acting inserts, which lining layer rests on a bottom plate together with which it forms the bottom contact connected as anode, the bottom contact being insulated from the metallic shell of the furnace vessel by insulating material.

The invention makes reference here to a prior art as results, for example, from U.S. Pat. No. 4,228,314.

2. Discussion of Background

In direct-current electric-arc furnaces, both the electrode connected as cathode and the hearth or bottom electrode, which as a rule is constructed as a bottom contact, e.g. according to U.S. Pat. No. 4,228,314, must be insulated from the metallic shell of the furnace vessel. In the known electric-arc furnace, the bottom contact and the adjoining parts of the bottom lining rest on a metal plate. This metal plate in turn rests on a layer of insulating material on the (metallic) vessel bottom. The electrical connection of the bottom contact is made here via contact parts which are passed through openings in the vessel bottom. The insulating layer is highly stressed both by the weight of the charge and the extreme temperatures occurring during the furnace operation. Special cooling of this area is very expensive.

SUMMARY OF THE INVENTION

Accordingly, one object of this invention is to provide a novel direct-current electric-arc furnace of the generic category mentioned at the beginning whose bottom contact is optimally insulated from the vessel shell and the insulation withstands all operating stresses.

This object is achieved according to the invention when the bottom plate essentially forms the vessel bottom, which bottom plate overlaps a part, projecting to the inside, of the metallic shell of the furnace vessel and, with an insulating material, or a material which is at least a poor electrical conductor, inbetween, is supported thereon.

The advantage of the invention can be seen in particular from the fact that the entire bottom section of the electric-arc furnace is suspended as it were in a floating manner in the furnace shell, and the insulation of this bottom section from the furnace shell is simple to effect.

Exemplary embodiments of the invention as well as the advantages achievable therewith are described in greater detail below with reference to the drawing.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
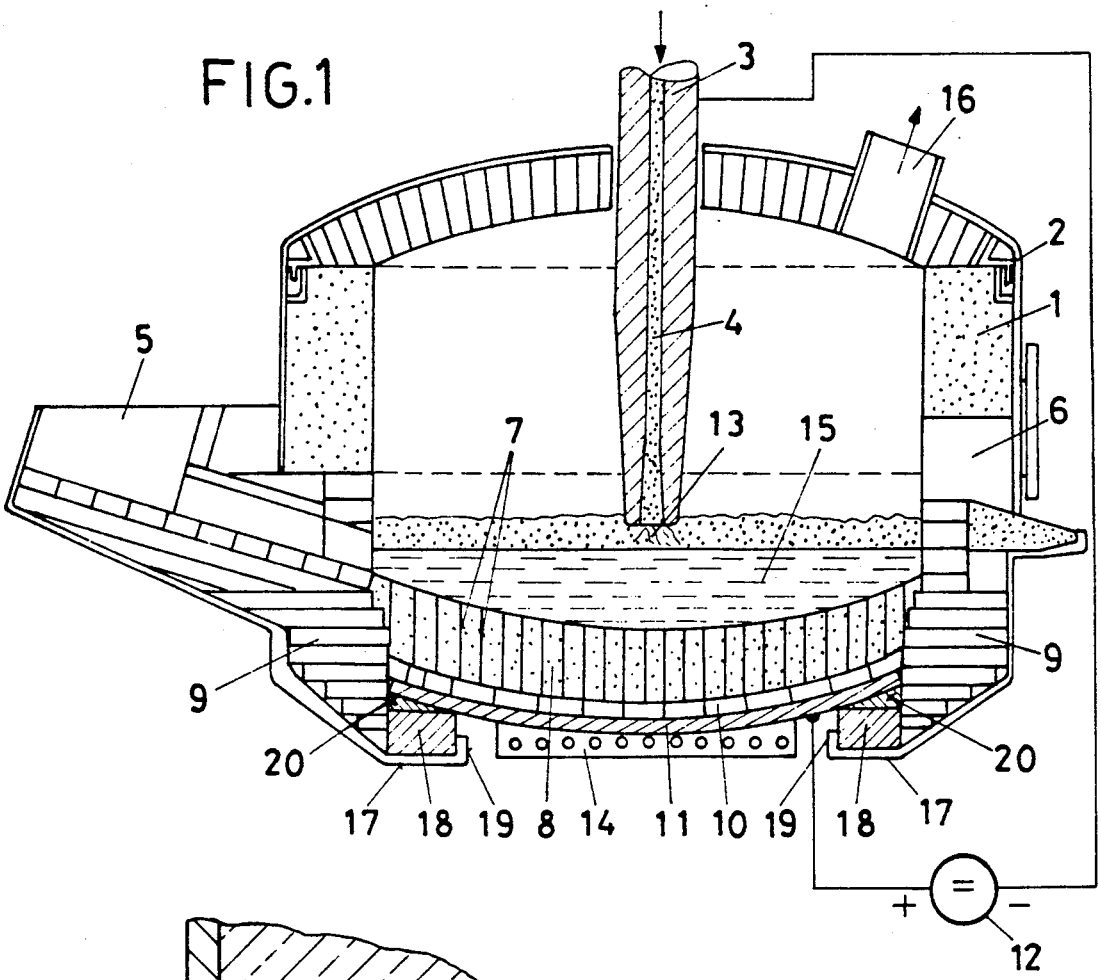
FIG. 1 schematically shows a first exemplary embodiment of a direct-current electric-arc furnace according to the invention in side view.

Referring now to the drawings, wherein like reference numerals designate identical or corresponding parts in both of the different views, FIG. 1 shows a direct-current electric-arc furnace having a furnace vessel 1 which is provided with the conventional shell 2 made of metallic material. In the exemplary embodiment, the furnace has only one electrode 3 connected as cathode, but it can also have two, three or more. In the exemplary embodiment, the electrode is of hollow design, i.e. the furnace is suitable for reduction purposes. But the subject matter of the invention can also be used in a melting furnace having a solid electrode connected as cathode, normally a graphite electrode.

In the reduction case, concentrates, coke and lime, for example for the manufacture of pig iron, is fed through the central channel 4 in the electrode, and an electrode spot, i.e. a slag-free surface of the melt, is obtained in the conventional manner under the electrode 3. As usual, the furnace has a pouring lip 5 and a door (sic) hole 6. A bottom contact is attached in the base of the furnace. The bottom contact consists of bricks 8 in which metallic conductors 7 are arranged. The conductors 7 penetrate into a bottom lining layer 10 lying underneath which, in the example, consists of electrically conductive carbon bricks. Adjoining to the outside is the conventional furnace brick lining 9. The bricks of the bottom lining layer 10 are arranged in one or more courses and lie on a bottom plate 11 formed like a spherical surface. This bottom plate 11 has a considerable extent and forms the bottom of the furnace. It is made of steel or copper and is connected to the positive pole of the direct-current source 12. The bottom contact is to have a large extent so that spreading of the furnace current over a large part of the bottom is achieved, as a result of which inclination of the electric arc 13 is essentially prevented. The bottom plate 11 is provided with a cooling device 14 so that it can be kept at as low a temperature as possible and is not damaged by the heat of the furnace and 16 is a suction opening for exhaust gases.

The bricks 8 provided with conductors 7 serve as current conductors between the charge 15 and the bottom contact consisting of outer lining layer 10 and the bottom plate 11, which bottom contact can of course also be of different construction. Thus other contact-making components can be present instead of the carbon bricks.

In this respect, the direct-current electric-arc furnace corresponds to the prior art and is described in detail in U.S. Pat. 4,228,314 mentioned at the beginning or also in German Patent Specification 3,022,566.

According to the invention, the shell 2 of the furnace vessel is drawn radially inward and forms a collar 17 projecting to the inside. The bottom plate 11 overlaps the collar 17 in the radial direction. A ring 18 of insulating material is arranged in the overlapping area. In this way, the entire bottom section of the furnace is supported on the collar 17. The bottom section of the furnace floats as it were in the furnace vessel 1. At the same time, the electrical insulation between furnace shell 2 and bottom plate 11 and thus the bottom contact is effected via the insulating material 18.

The bent-up end 19 of the collar 17 is used for radial centering, which end 19, however, does not extend up to the bottom plate. In order to pass the forces to the insulating material in a clearly defined manner, the marginal section of the bottom plate 11 is provided with a compensating ring 20 designed roughly in a wedge shape in cross-section.

Either prefabricated parts, e.g. bricks or clinkers of refractory material, arranged loosely in layers one above the other or connected to one another by refractory mortar, or a casting or ramming mass can be used as insulating material. The essential factor here, apart from the low electrical conductivity, is that the insulating material withstands the compressive stresses. Furthermore, it need not be an insulator in the actual sense. It is sufficient if the electrical conductivity of the insulating material is less than the conductivity of the bottom contact in the direction of the vertical axis of the furnace by at least a power of ten.

Figure 2:
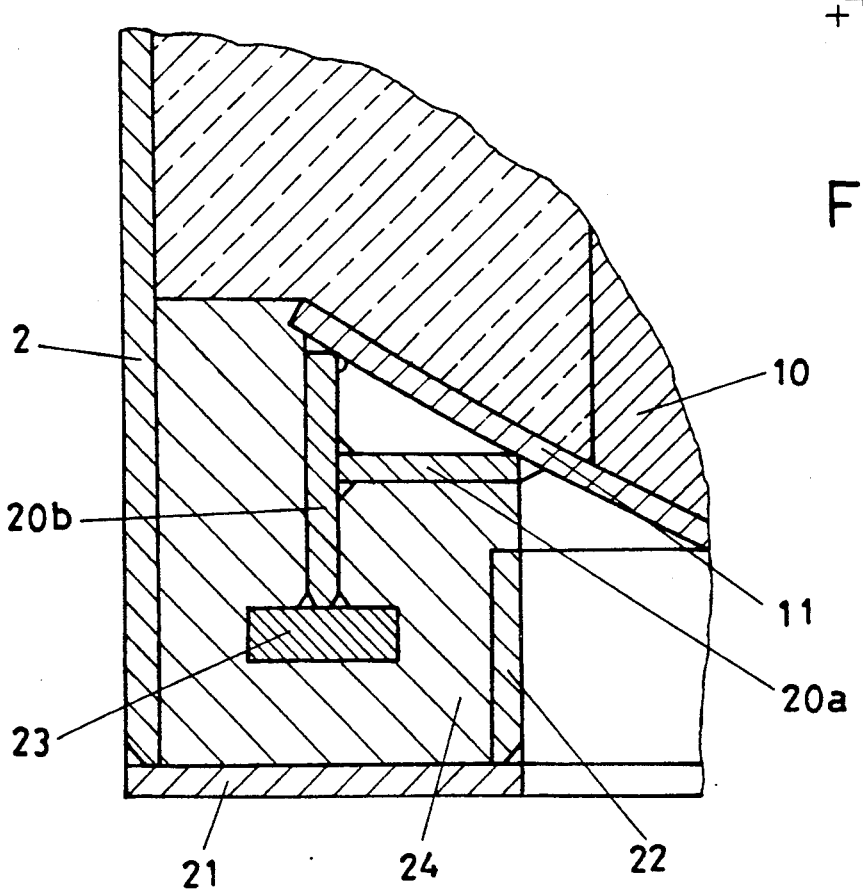
FIG. 2 shows a detail of the support and insulation of the bottom section in another type of furnace vessel.

The embodiment just mentioned having a casting or ramming mass is illustrated in FIG. 2 in a direct-current electric-arc furnace having a different construction of the furnace shell or bottom.

An annular plate 21 is fixed to the cylindrical vessel shell 2. An axially running pipe piece 22 is welded to the inner periphery of this plate 21. With regard to its function, the annular plate 21 corresponds to the collar 17 and the pipe piece 22 corresponds to the bent end 19 of the collar 17 in FIG. 1. In an analogous manner to FIG. 1, the bottom plate 11, in its marginal area, is provided with a compensating ring which is here designed as a welded construction and has a radially running ring 20*a* and an axially running pipe piece 20*b*. The pipe piece 20*b* is extended down beyond the plate 20*a* and is welded to a supporting ring 23.

In the course of manufacture of the furnace, before the furnace brick lining is incorporated, the bottom plate 11 is inserted together with the parts 20*a*, 20*b* and 23 and, by means of insulating spacers (not shown in the drawing), is oriented and provisionally fixed relative to the furnace shell 2 and the plate 21. A casting or ramming mass 24, e.g. refractory concrete, is then poured into the space between vessel shell 2 and pipe piece 22 and the area adjoining to the top, and in fact in such a way that the rings 20*a* and 23 and the pipe piece 20*b* are completely embedded into this mass. This is followed by the further construction of the furnace in a known manner.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A direct-current electric-arc furnace comprising:

a furnace vessel surrounded by a metallic shell;

at least one electrode connected as a cathode; and at least one bottom contact at a bottom portion of said furnace;

the bottom portion of the furnace comprising:

a lining layer having electrically conductive bricks; and a bottom plate which substantially constitutes a bottom of said furnace vessel, said lining layer lying on said bottom plate and said bottom plate and said lining layer together forming said bottom contact connected as an anode, said bottom contact being insulated from the metallic shell of the furnace vessel by insulating material;

a lower end of said metallic shell comprising a collar which projected radially inward, said insulating material being disposed on said collar;

said bottom plate overlapping said collar in a radial direction such that said bottom plate is supported by said collar with said insulating material disposed between said collar and said bottom plate;

said bottom plate being provided with cooling means which covers a substantial portion of a lower end of said bottom plate for keeping the bottom plate at a low temperature and preventing damage to said bottom plate by heat from the furnace.

2. The electric-arc furnace as claimed in claim 1, wherein said collar is connected in one piece to the metallic shell of the vessel.

3. The electric-arc furnace as claimed in claim 1, wherein said collar is an annular plate which is firmly connected to the lower end of the metallic shell of the vessel.

4. The electric-arc furnace as claimed in claim 2 or 3, wherein the bottom plate is curved and is provided in a peripheral area with a compensating ring.

5. The electric-arc furnace as claimed in claim 4, wherein the insulating material comprises individual building blocks, which are arranged loosely in layers.

6. The electric-arc furnace as claimed in claim 4, wherein the insulating material is a casting or ramming mass of refractory material.

7. The electric-arc furnace as claimed in claim 6, wherein an electrical conductivity between said collar and said bottom plate is smaller by at least a factor of 10 than the conductivity of the bottom contact.

8. The electric-arc furnace as claimed in claim 4, wherein the insulating material comprises individual building blocks which are connected to one another by a refractory mortar.

* * * * *